US007094088B2

(12) United States Patent
Wang et al.

(10) Patent No.: US 7,094,088 B2
(45) Date of Patent: Aug. 22, 2006

(54) ELECTRICAL CONNECTOR HAVING IMPROVED CONNECTION

(75) Inventors: Ning Wang, Kunsan (CN); Guang-Ming Zhao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,599

(22) Filed: Jun. 27, 2005

(65) Prior Publication Data

US 2006/0128194 A1 Jun. 15, 2006

(30) Foreign Application Priority Data

Dec. 14, 2004 (CN) ..... 2004 2 0054464

(51) Int. Cl.
*H01R 29/00* (2006.01)

(52) U.S. Cl. ..... 439/188; 439/668; 439/944

(58) Field of Classification Search ..... 439/188, 439/668, 944, 669; 200/51.09, 51.1, 51.11
See application file for complete search history.

(56) References Cited

U.S. PATENT DOCUMENTS 4,426,558 A * 1/1984 Tanaka et al. ..... 200/51.09
5,893,767 A * 4/1999 Broschard, III ..... 439/188
6,270,380 B1 8/2001 Shichida et al.
6,312,274 B1 11/2001 Lin
6,319,030 B1 * 11/2001 Wu ..... 439/188
6,382,999 B1 * 5/2002 Mou et al. ..... 439/188

* cited by examiner

*Primary Examiner*—James R. Harvey
(74) *Attorney, Agent, or Firm*—Wei Te Chung

(57) ABSTRACT

An electrical connector (100) includes an insulative housing (10), a movable contact (23) and a fixed contact (22). The insulative housing defines a receiving hole (12) for receiving a mating plug (4) therein. The movable contact comprises a base portion (230) received in the insulative housing. A flexible portion (231) and a connecting portion (232) both extend from the base portion. The fixed contact comprises a base portion (221) received in the insulative housing. Two separated contacting portions (222) and a soldering portion (223) both extend from the base portion. The contacting portions of the fixed contact disconnect the flexible portion of the movable contact only when the mating plug is completely inserted into the receiving hole of the insulative housing.

11 Claims, 4 Drawing Sheets

ELECTRICAL CONNECTOR HAVING IMPROVED CONNECTION

BACKGROUD OF THE INVENTION

1. Field of the Invention

The present invention generally relates to an electrical connector, and particularly relates to an electrical connector having improved connection of contacts thereof.

2. Description of Related Arts

Audio jack connector is widely used in the electric industry for providing audio signals transmission between two electrical equipments. This kind of connector is connected to a printed circuited board to form a circuit with a mating connector. U.S. Pat. Nos. 6,270,380 and 6,312,274 all disclose an audio jack with switch contacts. The switch contacts are connected and broken off to shift different signal circuits.

U.S. Pat. No. 6,270,380 discloses an audio jack having two pair of switch contacts. Each pair of switch contacts includes a flexible movable contact and a non-flexible fixed contact. The end of the movable contact flexibly contacts the fixed contact to form a signal circuit. Nevertheless, when a mating connector is inserted into the audio jack, columned plug of the mating connector separates the connection of the movable contact and the fixed contact, and contacts with the movable contact to form another signal circuit. U.S. Pat. No. 6,312,274 also has an audio jack with a pair of switch contact, which shifts two different circuits by mating and un-mating a complementary connector.

However, repeated mating and un-mating with a complementary plug may result in elastic failure of the flexible movable contact. To enhance the flexibility of the movable contact, we can increase the length of the flexible portion of the movable contact. But this means is limited to the structure of the electrical connector itself, so it is not practical enough to overcome the problem. Furthermore, the movable contact disclosed in U.S. Pat. No. 6,270,380 contacts the fixed contact absolutely by its distal end. If dusts adhere to the end of the contact, it may lead to bad electrical connection even disconnection, and result in failure of switch.

Hence, it is desirable to have an improved electrical connector to overcome the above-mentioned disadvantages of the related art.

SUMMARY OF THE INVENTION

It is an object of the present invention to provide an electrical connector with switch contacts better connection to each other.

In order to achieve the above-mentioned object, an electrical connector includes an insulative housing, a movable contact and a fixed contact. The insulative housing defines a receiving hole for receiving a mating plug therein. The movable contact comprises a base portion received in the insulative housing. A flexible portion and a connecting portion both extend from the base portion. The fixed contact comprises a base portion received in the insulative housing. Two separated contacting portions and a soldering portion both extend from the base portion. The contacting portions of the fixed contact disconnect the flexible portion of the movable contact only when the mating plug is completely inserted into the receiving hole of the insulative housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
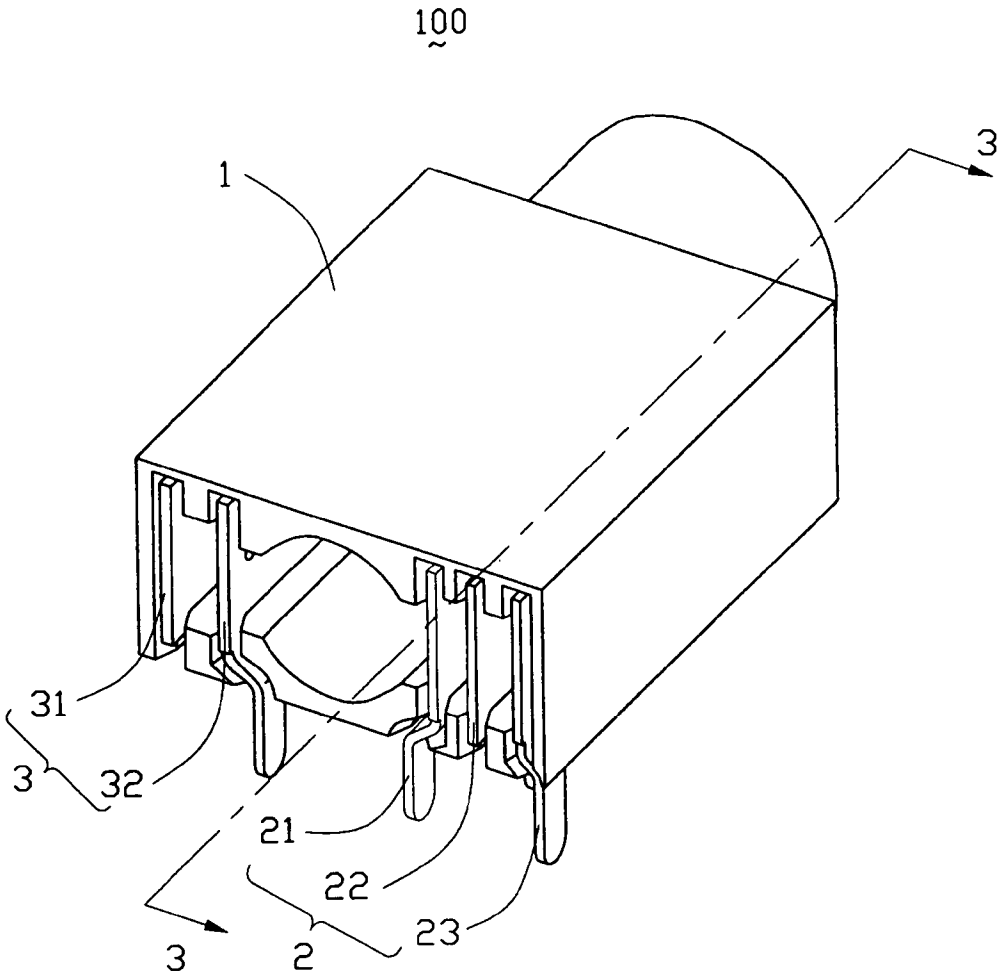
FIG. 1 is a rear perspective view of an electrical connector in accordance with the present invention.

Reference will now be made to the drawing figures to describe the present invention in detail.

With reference to FIG. 1, an electrical connector 100 in accordance with present invention comprises an insulative housing 1, a first contact set 2 and a second contact set 3 both received in the insulative housing 1. Each of contact set 2 and 3 comprises several contacts respectively to constructive a switch transferring different circuits.

Figure 2:
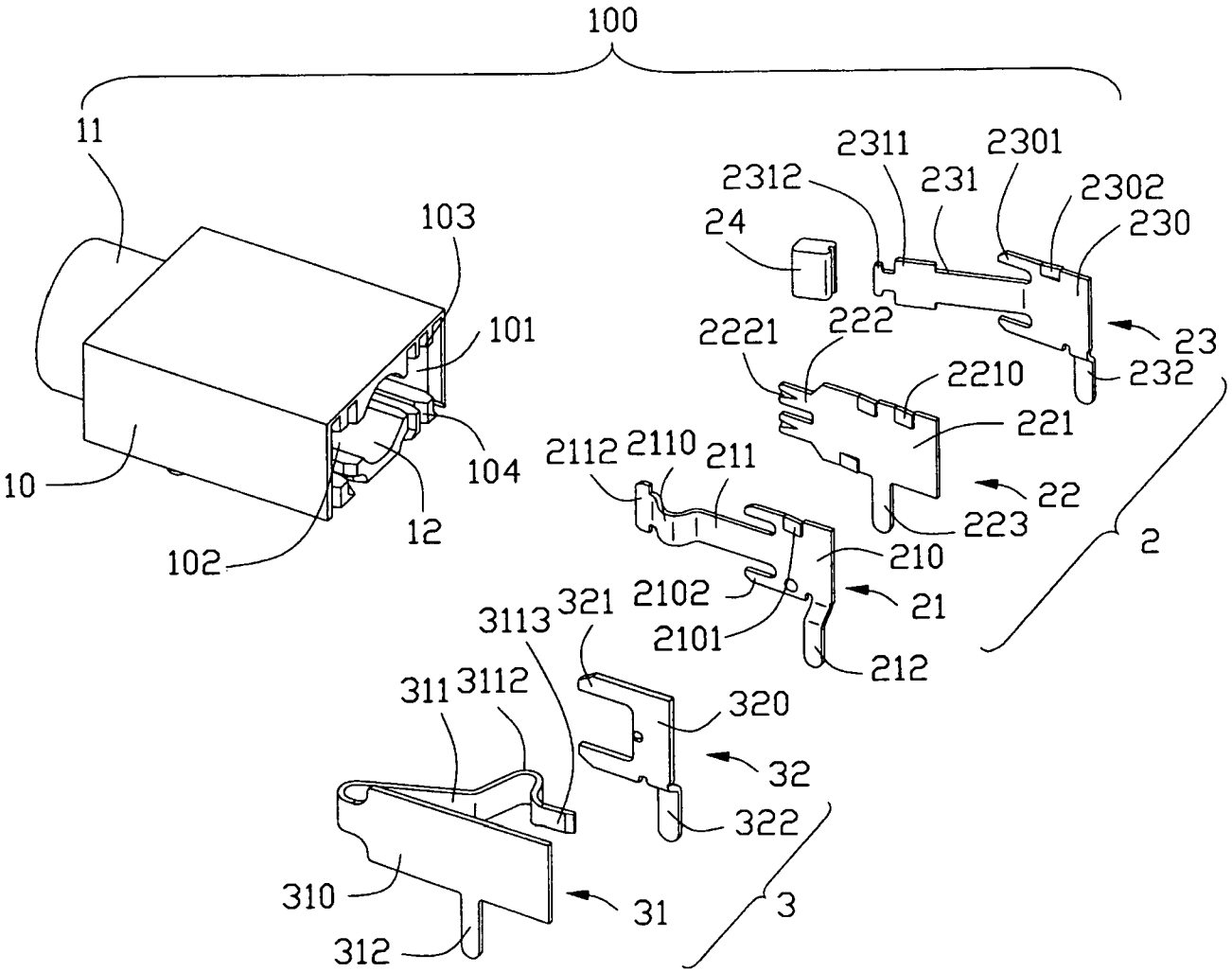
FIG. 2 is an exploded perspective view of the electrical connector of FIG. 1.

Referring to FIGS. 1–2, the insulative housing 1 is of lengthways shape and has a cuboid main body 10. A boss portion 11 is integrated with the main body 10 and protrudes from one side of the main body 10. A receiving hole 12 runs through the boss portion 11 and the main body 10 in a lengthwise direction. In other word, it runs through the front and rear ends of the insulative housing 1. The main body 10 forms contact embedding spaces 101, 102 at two sides of the receiving hole 102 thereof. The contact embedding spaces 101, 102 consist of several channels, detailed speaking, the upper and lower wall each defines upper channels 103 and lower channels 104 symmetrically in the vertical direction. Each pair of upper and lower channel accommodates a contact therein. The electrical connector of this invention totally forms five pairs of channels to retain five contacts 31, 32, 33 34 and 35 therein, as shown in FIG. 1.

FIG. 2 shows the second contact set 2 retained in the contact embedding space 101. The second contact set 2 comprises a first contact 21, a second contact 22 and a third contact 23. The first contact 21 has a base portion 210 to fit in corresponding channel by fixing members 2101, 2102 formed thereon. The base portion 210 extends an elastic portion 211 from one end thereof, and the end of the elastic portion 211 forms an angled contacting member 2110. The distal end of the angled contacting member 2110 further extends an abutting member 2112. The first contact 21 further has a soldering portion 212 extending from another end of the base portion 210.

The second contact 22 comprises a base portion 221, two contacting portions 222 extending from the base portion 221 and a solder portion 223 elongating from lower edge of the base portion 221. The base portion 221 forms several fixing members 2210 to retain the second contact 22 in the housing 10. The two contacting portions 222 are slender and separated with each other. The whole width of the two contacting portions 222 is smaller than that of the base portion 221. Each contacting portion 222 forms a protruded contacting point 2221 at a front part of a side face thereof.

The third contact 23 also has a base portion 230, a flexible portion 231 and a connecting portion 232. The base portion 230 bridges the flexible portion 231 and the connecting portion 232. The flexible portion 231 bends off the base portion 230 towards the second contact 22, in other words, the flexible portion 231 and the base portion 230 are not in a plane. The base portion 230 forms fixing members 2301, 2302 to retain the third contact 23 in corresponding channel. The flexible portion 231 forms a broadened member 2311 wider than other part of the flexible portion 231 at its free end thereof, and a tail member 2312 is formed at the distal end. The tail member 2312 is T-shaped and is narrower than the broadened member 2311. A plastic sheath 24 surrounds the tail member 2312.

Referring to FIG. 2 again, the second contact set 3 comprises a fourth contact 31 and a fifth contact 32, which fit in the contact embedding space 102. The fourth contact 31 comprises a base member 310, a flexible portion 311 deflected from the plane of the base member 310 and a soldering portion 312 extended from the base member 310. The flexible portion 311 forms an arced contacting member 3112 at its free end. The distal end of the arced contacting member 3112 forms an abutting member 3113 which is parallel to the base portion 310 approximately. The fifth contact 32 includes a base portion 320, two fixing portion 321 and a soldering portion 322. The fourth contact 31 and the fifth contact 32 are retain in corresponding channels too.

Figure 3:
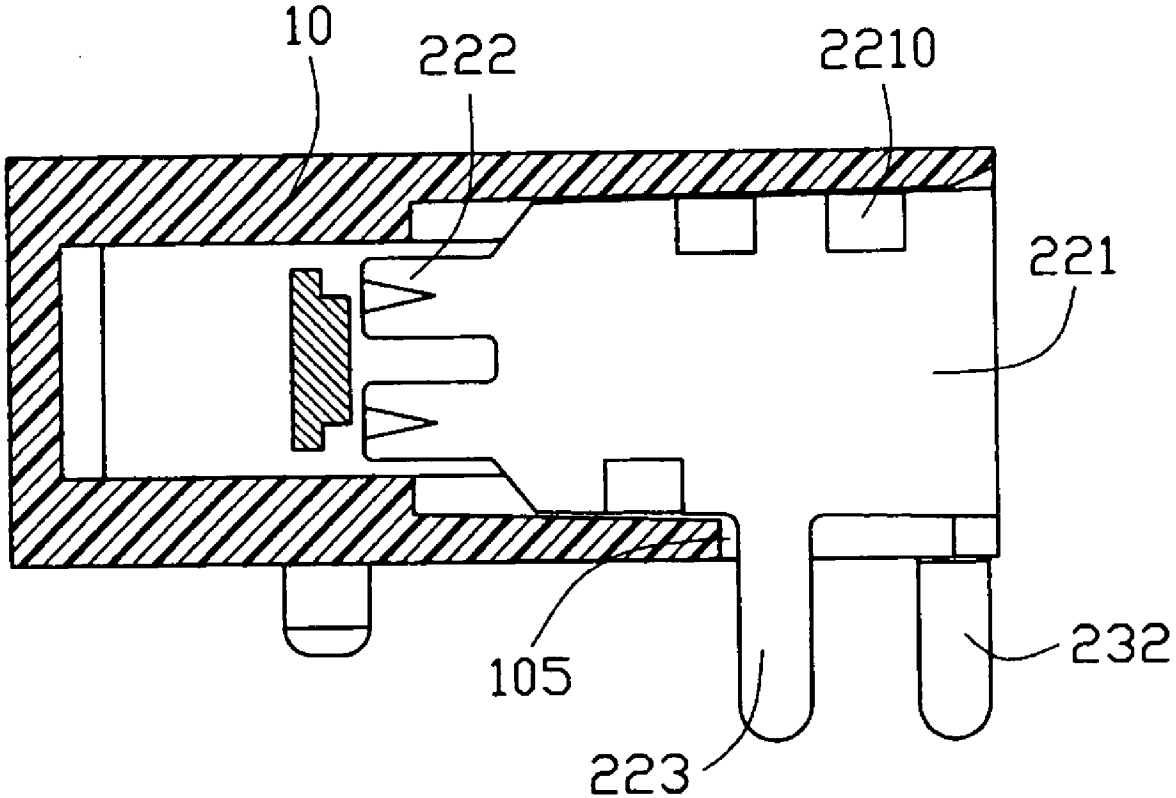
FIG. 3 is a cross-sectional view taken on line 3—3 in FIG. 1.

The complete configuration of this electrical connector is shown in FIG. 1, wherein all the contacts are inserted into corresponding channels from the back of the housing 10. Fixing parts of each contact fix the contact in corresponding channel, and each soldering portion of each contact is soldered to a printed circuited board (not shown). FIG. 3 shows the second contact 22 received in a channel. The fixing members 2210 of the base member 221 engage with the sides of the channel, contacting portions 222 connect to the flexible portions 211, 231 of the first contact 21 and the third contact 231. The soldering portion 223 cross the gap 105 to connect to the printed circuited board.

Figure 4:
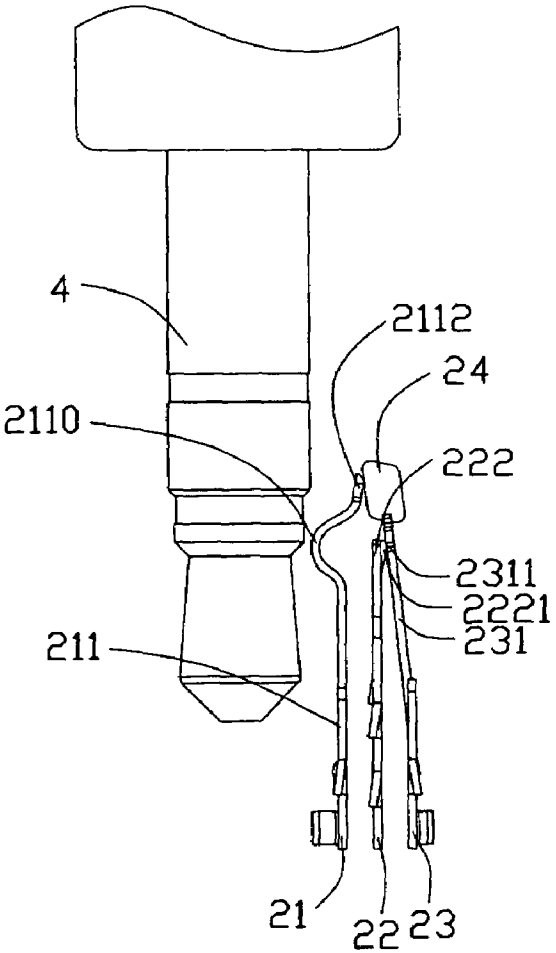
FIG. 4 is an illustrative view of a first contact set and a mating plug, showing the mating plug not completely mating with the present connector.

In each contact set, the flexible portion of a contact and the contacting portion of another contact electrically connect with each other to form a switch. As shown in FIG. 4, the abutting member 2112 of the first contact 21 abuts against the plastic sheath 24. The contacting portions 222 of the second contact 22 contacts the broadened member 2311 of the flexible portion 231 of the third contact 23 by the points 2221 formed thereon. Therefore, the second contact 22 and the third contact 23 are electrically connected to form a switch. Again referring to FIG. 2, the fourth contact 31 and the fifth contact 32 contacts to form another switch.

Figure 5:
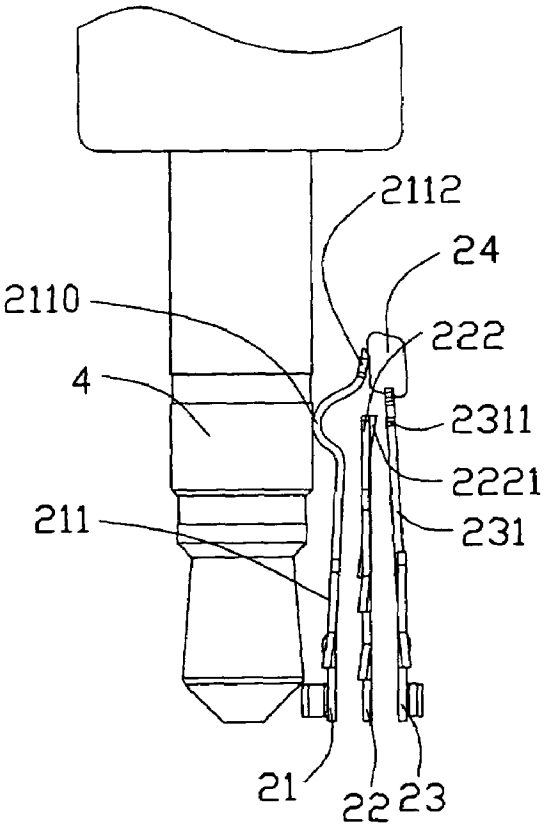
FIG. 5 is an illustrative view of a first contact set and a mating plug, showing the mating plug completely mating with the present connector.

Taking reference to FIG. 5, a mating plug 4 is inserted into the receiving hole 12 of the electrical connector. While inserting, the arced contacting portion 2110 of the first contact 21 is pressed by a mating terminal (not labeled) to push the plastic sheath 24 in a direction away from the mating plug 4. Then, the broadened member 2311 disconnects the points 2221 of the second contact 22. The connection between the second contact 22 and the third contact 23 is broken, and a circuit between the mating plug 4 and the first contact 21 is formed. Therefore, the first contact 21 is also called communicate contact. By the same principle, the connection between the fourth contact 31 and the fifth contact 32 is broken by the mating plug. The mating plug 4 and the fourth contact 31 forms another circuit.

When the mating plug 4 is extracted from the receiving hole 12, force on the first contact 21 misses, which make the flexible portion 210 restore to its free status. Then, the flexible portion 231 of the third contact 23 is back to its first place to contact the second contact 22. The connection between the second contact 22 and the third contact 23 is renewed. The fourth contact 31 and the fifth contact 32 rebuild their connection too. During the insertion/extraction of the mating plug, the third contact 23 and the fourth contact 31 are movable by the press of the mating plug, so they are called movable contacts. And the second contact 22 and the fifth contact 32 are fixed contacts.

The electrical connector 100 of the present invention has switch contacts to control the signal transmission. The fixed contact 22 forms two separated contacting portions 222 to electrically connect corresponding movable contact 23. When one contacting portion does not contact the movable contact 23 well or even disconnect it, another one can also have a connection. Therefore, it can effectively minish bad connection and prolong the use of the connector. Furthermore, the two contacting portions 222 are slender and not fix in the channel, the whole width of the two contacting portions 222 is smaller than that of the base portion 221, so they have a little flexibility. It also improves the connection between the fixed contact and the movable contact.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing defining a receiving hole for receiving a mating plug;

a movable contact comprising a base portion retained in the insulative housing, a flexible portion and a connecting portion both extending from the base portion; and a fixed contact comprising a base portion retained in the insulative housing, two separated contacting portions and a soldering portion both extending from the base portion; wherein the contacting portions of the fixed contact disconnect the flexible portion of the movable contact only when the mating plug is completely inserted into the receiving hole of the insulative housing;

wherein the electrical connector further comprises a communicate contact non-electrically abutting against the movable contact, and wherein the mating plug engages the communicate contact to make the movable contact break away from the fixed contact;

wherein the communicate contact non-electrically connects the movable contact by an insulative member sandwiched there between;

wherein the insulative member is attached to the distal end of the movable contact, and wherein the communicate contact has an abutting portion abutting against the insulative member.

2. The electrical connector as described in claim 1, wherein each contacting portion of the fixed contact is free in the insulative housing.

3. The electrical connector as described in claim 2, wherein the flexible portion of the movable contact forms a broadened member wider than other part of the flexible portion, and each contacting portion of the fixed contact is formed with a protruded contacting point for connecting the broadened member of the movable contact.

4. The electrical connector as described in claim 1, wherein the flexible portion of the movable contact bends off the base portion towards the fixed contact.

5. The electrical connector as described in claim 1, wherein the communicate contact forms an angled contacting member protruding into the receiving hole of the insulative housing.

6. The electrical connector as described in claim 5, wherein the mating plug imposes a pressing force on the angled contacting member of the communicate contact in a direction perpendicular to a mating direction for pushing the movable contact disconnecting the fixed contact.

7. The electrical connector as described in claim 1, wherein the insulative housing defines a contact embedding space comprises several channels defined symmetrically at both upper and lower wall of the insulative housing, and each pair of upper and lower channels retain one contact therein.

8. The electrical connector as described in claim 7, wherein the channels extend forward from the rear the insulative housing a certain distance.

9. An electrical connector comprising:

an insulative housing defining a mating cavity;

a flexible contact disposed in the housing and defining a first contact region; and a fixed contact disposed in the housing beside said flexible contact and defining a second contact region in alignment with said first contact region in a direction along which the flexible contact is moveable;

at least one of said first and second contact regions defining two separate/independent contact segments; wherein the flexible contact is moved along said direction when a complementary connector is inserted into said mating cavity;

another flexible contact which actuates the flexible contact to move when the complementary connector is inserted into the mating cavity;

wherein at least one of said flexible contact and said another flexible contact is equipped with an insulator to electrically isolate each other when said another flexible contact actuates said flexible contact; and wherein said fixed contact is disposed between said flexible contact and said another flexible contact.

10. The electrical connector as claimed in claim 9, wherein said first contact region is constantly engaged with the second contact region when no complementary connector is inserted into the mating cavity.

11. An electrical connector assembly comprising:

an insulative housing defining a mating cavity;

a fixed contact disposed in the housing;

a first flexible contact disposed in the housing constantly engaged with the fixed contact;

a second flexible contact disposed in the housing constantly spaced from the first flexible contact;

a complementary connector being inserted into the mating cavity to deflect the second flexible so as to engage and further actuate the first flexible contact to move away from the fixed contact; wherein at least one of said first flexible contact and said second flexible contact is equipped with an insulator to electrically isolate with each other when the second flexible contact engages the first flexible contact;

wherein said fixed contact is disposed between said flexible contact and said second flexible contact.

* * * * *